US010401077B2

(12) United States Patent
Chen et al.

(10) Patent No.: US 10,401,077 B2
(45) Date of Patent: Sep. 3, 2019

(54) CHILLED WATER COOLING SYSTEM

(71) Applicant: ALIBABA GROUP HOLDING LIMITED, George Town, Grand Cayman (KY)

(72) Inventors: Yanchang Chen, Hangzhou (CN); Yu Han, Hangzhou (CN)

(73) Assignee: ALIBABA GROUP HOLDING LIMITED, Grand Cayman (KY)

( * ) Notice: Subject to any disclaimer, the term of this patent is extended or adjusted under 35 U.S.C. 154(b) by 508 days.

(21) Appl. No.: 15/052,539

(22) Filed: Feb. 24, 2016

(65) Prior Publication Data

US 2016/0265834 A1 Sep. 15, 2016

(30) Foreign Application Priority Data

Mar. 13, 2015 (CN) ..... 2015 1 0110270

(51) Int. Cl.

| | |
|---|---|
| ***F28D 1/02*** | (2006.01) |
| ***F25B 19/00*** | (2006.01) |
| ***F25D 16/00*** | (2006.01) |
| ***F25D 31/00*** | (2006.01) |
| ***F28D 20/00*** | (2006.01) |

(52) U.S. Cl.

CPC ..... *F25D 16/00* (2013.01); *F25B 19/00* (2013.01); *F25D 31/002* (2013.01); *F28D 1/0226* (2013.01); *F28D 2020/0073* (2013.01)

(58) Field of Classification Search

CPC .. F25D 16/00; F25D 23/12; F24F 5/00; F25B 2400/06; F28D 20/02; Y02B 30/242

See application file for complete search history.

(56) References Cited

U.S. PATENT DOCUMENTS

| | | | | |
|---|---|---|---|---|
| 5,005,371 | A | 4/1991 | Yonezawa et al. | |
| 5,040,377 | A | 8/1991 | Braun et al. | |
| 6,672,099 | B1 * | 1/2004 | Yoshimi | F25B 19/00 62/315 |

(Continued)

FOREIGN PATENT DOCUMENTS

| | | | |
|---|---|---|---|
| CN | 2646600 | Y | 10/2004 |
| CN | 101713575 | A | 5/2010 |

(Continued)

OTHER PUBLICATIONS

PCT International Search Report and Written Opinion dated Apr. 22, 2016, issued in corresponding International Application No. PCT/US16/19298 (9 pages).

(Continued)

*Primary Examiner* — Elizabeth J Martin

(74) *Attorney, Agent, or Firm* — Finnegan, Henderson, Farabow, Garrett & Dunner, LLP

(57) ABSTRACT

A chilled water cooling system includes a natural cooling circuit and a mechanical cooling circuit. The natural cooling circuit includes a natural cooler, a chilled water main pump, at least one first pipeline, and a terminal heat exchanger connected in series. The terminal heat exchanger is disposed at a location in need of cooling. The mechanical cooling circuit includes a chilled water main machine, a chilled water auxiliary pump, and at least one second pipeline connected in series. The mechanical cooling circuit is connected in parallel with the natural cooling circuit through a controllable connecting device.

19 Claims, 9 Drawing Sheets

(56) References Cited

U.S. PATENT DOCUMENTS

| | | | | |
|---|---|---|---|---|
| 2005/0144965 | A1 | 7/2005 | Ueda et al. | |
| 2006/0010893 | A1 | 1/2006 | Dominguez | |
| 2008/0162077 | A1 | 7/2008 | Chang et al. | |
| 2008/0173031 | A1 | 7/2008 | Duesel et al. | |
| 2010/0077776 | A1* | 4/2010 | Takenami | F25D 16/00 62/98 |
| 2010/0307171 | A1 | 12/2010 | Hamann et al. | |
| 2012/0318009 | A1 | 12/2012 | Duesel, Jr. et al. | |
| 2013/0037254 | A1 | 2/2013 | Carlson et al. | |

FOREIGN PATENT DOCUMENTS

| | | | |
|---|---|---|---|
| CN | 103344023 | A | 10/2013 |
| CN | 103912949 | A | 7/2014 |
| GB | 2471834 | A | 1/2011 |
| JP | 2008-215679 | A | 9/2008 |
| WO | WO 2008/009296 | A1 | 1/2008 |

OTHER PUBLICATIONS

First Chinese Search Report Issued by the State Intellectual Property Office of People's Republic of China in corresponding Chinese Application No. 201510110270.2, dated Jul. 9, 2018. (2 pages).
First Chinese Office Action Issued by the State Intellectual Property Office of People's Republic of China in corresponding Chinese Application No. 201510110270.2, dated Jul. 20, 2018 (17 pages).

* cited by examiner (Prior Art)

CHILLED WATER COOLING SYSTEM

RELATED APPLICATIONS

This application is based upon and claims priority to Chinese Patent Application No. 201510110270.2, filed Mar. 13, 2015, the entire contents of which are incorporated herein by reference.

TECHNICAL FIELD

The present disclosure generally relates to the field of cooling system and, more particularly, to a chilled water cooling system.

BACKGROUND

Data centers and computing machine rooms need a large cooling system to cool servers, memory equipment, and network devices. A chilled water system is widely employed in all places that need long-term cooling the whole year, such as a large-scale data center, a switch room, etc. In low-temperature climate areas, the cooling systems in many of those places adopt a natural cooling technology. In a transition season or low-temperature season, the chilled water systems can use an outdoor cold source for free, without activating a chilled water main machine, thereby reducing a great deal of electricity usage for users. In most of data centers, the supplied and returned water temperatures of their chilled water systems are 10 and 15° C., respectively, and temperatures of air of its air conditioners are 13° C. Because of the relatively low supplied and returned water temperatures, the time in which a natural cooling technology may be utilized is relatively short.

A conventional chilled water natural cooling system includes a combination of an air-cooled chilled water main machine and a natural cooler, which is, generally, a closed cooling tower. As shown in FIG. 1, an air-cooled chilled water main machine 11 is connected in series with a natural cooler 10 and to a water supplying/returning end of a heat exchanger 12 of an air-conditioning terminal through a three-way valve 13. Meanwhile, the three-way valve 13 is further connected to a pipeline by which the air-cooled chilled water main machine 11 is connected in series with the natural cooler 10 through a valve 14.

In a mechanical cooling mode, when an outdoor air temperature exceeds a returned water temperature (20° C.), chilled water will absorb, not dissipate, heat if it still passes through the natural cooler 10. Thus, under the circumstance, the three-way valve 13 is adjusted to a bypass mode, in which the valve 14 is opened, and returned water of the heat exchanger 12 at the air conditioning terminal does not pass the natural cooler 10, but runs through the air-cooled chilled water main machine 11. The air-cooled chilled water main machine 11 is started to cool the 20° C. chilled water to 15° C. by the mechanical cooling process (including activating a compressor, dissipating heat by a condenser, etc.). The chilled water of 15° C. is sent back to the heat exchanger 12 at the air-conditioning terminal.

In a natural cooling mode, an outdoor air temperature must be less than a temperature of the supplied water. For example, the temperature of the supplied water is 15° C. and the outdoor temperature is 12° C. Chilled water of 15° C. is supplied to heat exchanger 12 and warmed up to 20° C. after absorbing heat load from the air-conditioning terminal. The three-way valve 13 is adjusted to enable the chilled water to pass through the natural cooler 10 so that the 20° C. chilled water is cooled to 15° C. through the outdoor natural cooler 10, and in turn passes through the air-cooled chilled water main machine 11, which does not need to be activated to cool. The chilled water is then sent back to the heat exchanger 12 of the air-conditioning terminal, thereby forming a chilled water loop.

In a partial natural-cooling mode, a chilled water circulation loop is identical to that of natural cooling, but an outdoor air temperature is not low enough to cool the chilled water to 15° C. after it passes through the natural cooler 10. The air-cooled chilled water main machine 11 needs to be activated to cool the chilled water to 15° C. The chilled water of 15° C. is then supplied to the heat exchanger 12 of the air-conditioning terminal.

At present, temperatures of the vast majority of data centers are set to be very low. For example, when natural cooling systems are provided in the cooling system of the data centers, generally, they are designed to have the supplied and returned water temperature at 15° C. and 20° C., respectively. In those systems, the natural cooling mode will be turned on when the outdoor temperature is about 10° C.; the partial natural cooling mode is turned on when the outdoor temperature is about 18° C.; and the mechanical cooling mode is activated when the outdoor temperature is more than 18° C.

Thus, the chilled water in the conventional chilled water loop always passes through the chilled water main machine 11 and selectively enters the natural cooler 10 under the control of the three-way valve 13. That is, the chilled water main machine 11 is the primary cooling source, while the natural cooler 10 is employed to assist main machine 11. As the technology for information devices such as IT servers advances, devices such as servers gradually do not require to be maintained at a lower temperature. For example, the air temperature is recommended to be at 18-27° C. in the TC9.9 specification recently published by the ASHRAE (American Society of Heating, Refrigerating and Air-Conditioning Engineers). As the acceptable air temperature for the server is increased, the supplied and returned water temperatures of the chilled water in a cooling system may also be higher. The conventional cooling systems that primarily use the chilled water main machine 11 may not be sufficient to conserve energy.

SUMMARY

Consistent with embodiments of this disclosure, there is provided a chilled water cooling system. The chilled water cooling system includes a natural cooling circuit and a mechanical cooling circuit. The natural cooling circuit includes a natural cooler, a chilled water main pump, at least one first pipeline, and a terminal heat exchanger connected in series. The terminal heat exchanger is disposed at a location in need of cooling. The mechanical cooling circuit includes a chilled water main machine, a chilled water auxiliary pump, and at least one second pipeline connected in series. The mechanical cooling circuit is connected in parallel with the natural cooling circuit through a controllable connecting device. In some embodiments, the terminal heat exchanger may be a heat exchanger of an air-conditioning terminal or a heat exchanger of a liquid cooling system.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

Figure 1:
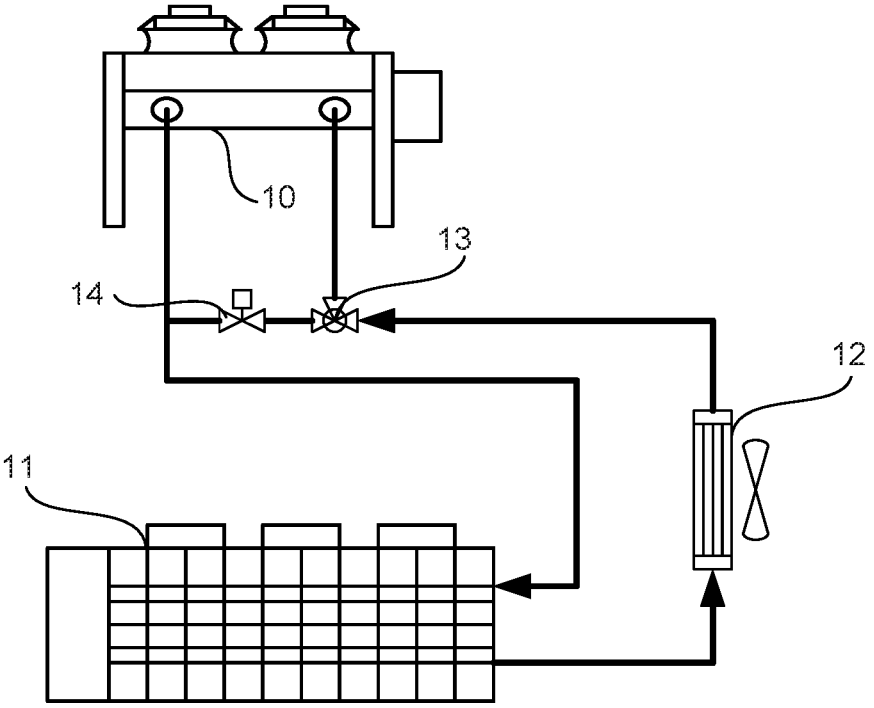
FIG. 1 is a schematic diagram of a conventional chilled water cooling system.
Figure 2:
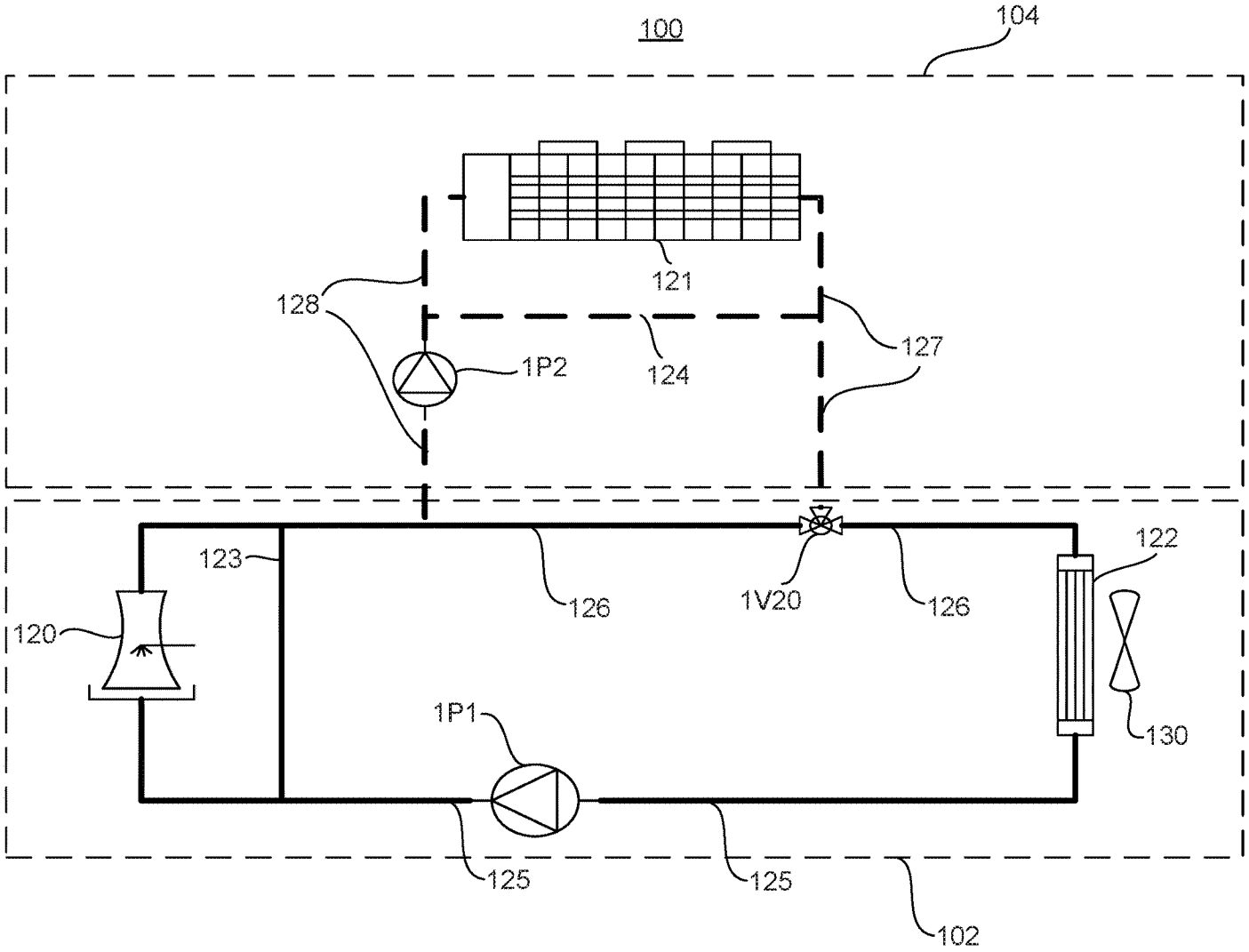
FIG. 2 is a schematic diagram of an exemplary chilled water cooling system in a natural cooling mode consistent with embodiments of this disclosure.
Figure 3:
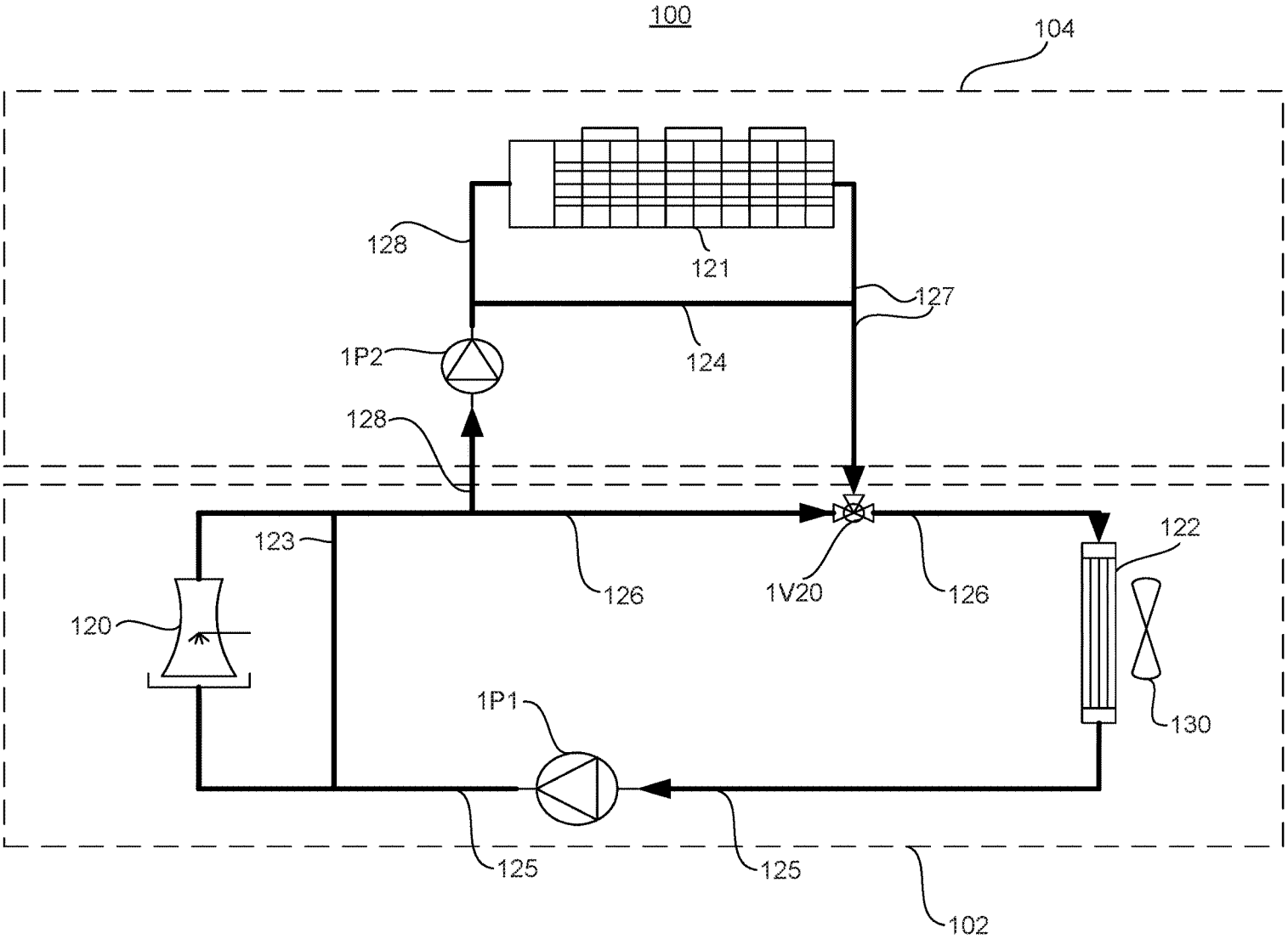
FIG. 3 is a schematic diagram of an exemplary chilled water cooling system in a partial natural cooling mode consistent with embodiments of this disclosure.

A first embodiment of the present disclosure provides a chilled water cooling system including a natural cooling circuit as a main cooling circuit and an air-cooled mechanical cooling circuit as an auxiliary cooling circuit. FIGS. 2 and 3 show a chilled water cooling system 100, in which FIG. 2 shows a schematic diagram of the chilled water cooling system 100 running in a natural cooling mode, and FIG. 3 shows a schematic diagram of the chilled water cooling system 100 running in a partial natural cooling mode.

As shown in FIGS. 2 and 3, the chilled water cooling system 100 includes a natural cooling circuit 102 and a mechanical cooling circuit 104. The natural cooling circuit 102 includes a cooling tower 120, a chilled water main pump 1P1, pipelines 125, 126, a first differential pressure bypass branch 123, a valve 1V20, and a heat exchanger 122 at the air-conditioning terminal 130. The mechanical cooling circuit 104 uses an air-cooled mechanism and includes an air-cooled chilled water main machine 121, a chilled water auxiliary pump 1P2, and a second differential pressure bypass branch 124. The cooling tower 120 may be a closed-type cooling tower, such as a spray closed-type cooling tower. The valve 1V20 may be a three-way valve, for example. The heat exchanger 122 of the air-containing terminal 130 may be a liquid cooling heat exchanger or any other terminal heat exchangers.

Hereinafter, a structure of the chilled water cooling system 100 will be explained in detail.

In the natural cooling circuit 102, one end of the cooling tower 120 is connected in series to one end of the heat exchanger 122 through the chilled water main pump 1P1 via the pipeline 125. The other end of the heat exchanger 122 at the air-conditioning terminal 130 is connected to one end of the cooling tower 120 through the pipeline 126 and valve 1V20. In order to provide an overpressure protection to the first cooling tower 120, the first differential pressure bypass branch 123 is connected to pipelines 125, 126 and in parallel with the cooling tower 120.

In the mechanical cooling circuit 104, ends of the air-cooled chilled water main machine 121 are connected to pipelines 127, 128, which are connected to the pipeline 126 extending between the cooling tower 120 of the natural cooling circuit 102 and the heat exchanger 122 of the air-conditioning terminal 130. One end of the pipeline 127 is connected to the pipeline 126 through the three-way valve 1V20. That is, the mechanical cooling circuit 104 is connected in parallel to the natural cooling circuit 102 via a controllable connecting device, e.g., the three-way valve 1V20. The chilled water auxiliary pump 1P2 is disposed on one of the pipelines 127 and 128 (128 shown in FIGS. 2 and 3).

The chilled water cooling system 100 may work in two modes, i.e. the natural cooling mode and the partial natural cooling mode.

Referring to FIG. 2, in the natural cooling mode, the three-way valve 1V20 switches on pipeline 126 connected between the cooling tower 120 and the heat exchanger 122 at the air-conditioning terminal 130, and blocks the connection to pipeline 127. In operation, the chilled water main pump 1P1 provides pressure to cause the chilled water returns from one end of the heat exchanger 122 to the cooling tower 120 through pipeline 125 after it absorbs the heat from the heat exchanger 122 at the air-conditioning terminal 130. When the chilled water passes through the cooling tower 120, the absorbed heat is exhausted to an outdoor environment by the chilled water through a cooling pipeline (not shown) of the cooling tower 120. As such, the temperature of the chilled water returning to the heat exchanger 122 at the air-conditioning terminal 130 can been reduced to a predetermined temperature so that the chilled water may be reused as a cooling medium in the heat exchanger 122 at the air-conditioning terminal 130 to take away heat again. Under this working mode, because the three-way mixing valve 1V20 closes the loop to mechanical cooling circuit 104, the chilled water only passes through the cooling tower 120, and the air-cooled chilled water main machine 121 is not activated to work.

Referring to FIG. 3, in the partial natural cooling mode, the three-way valve 1V20 is configured to allow the chilled water to flow between the pipeline 126 connecting the cooling tower 120 and the heat exchanger 122 at the air-conditioning terminal 130, and allow the chilled water running from pipeline 127. The chilled water main pump 1P1 and the chilled water auxiliary pump 1P2 are both turned on to drive the chilled water to flow in the circuit. The chilled water is first cooled by the cooling tower 120, and part of chilled water (for example, 20%) flowing through pipeline 128 is further cooled by the air-cooled chilled water main machine 121. The part of chilled water in pipeline 128 is driven by the chilled water auxiliary pump 1P2, and is mixed with the chilled water in the pipeline 126 via the three-way valve 1V20 after it is cooled by air-cooled chilled water main machine 121. The chilled water is forwarded to the heat exchanger 122 at the air-conditioning terminal 130 at a predetermined temperature or temperature range.

In the above-illustrated embodiment, the chilled water cooling system 100 uses the cooling tower 120 to cool chilled water, and uses the air-cooled chilled water main machine 121 for auxiliary cooling if needed. In some places where climatic conditions permit, the chilled water cooling system 100 may be configured to run with only the natural cooling circuit 102 and without the mechanical cooling circuit 104. This may greatly reduce investment and consumption of energy.

Figure 4:
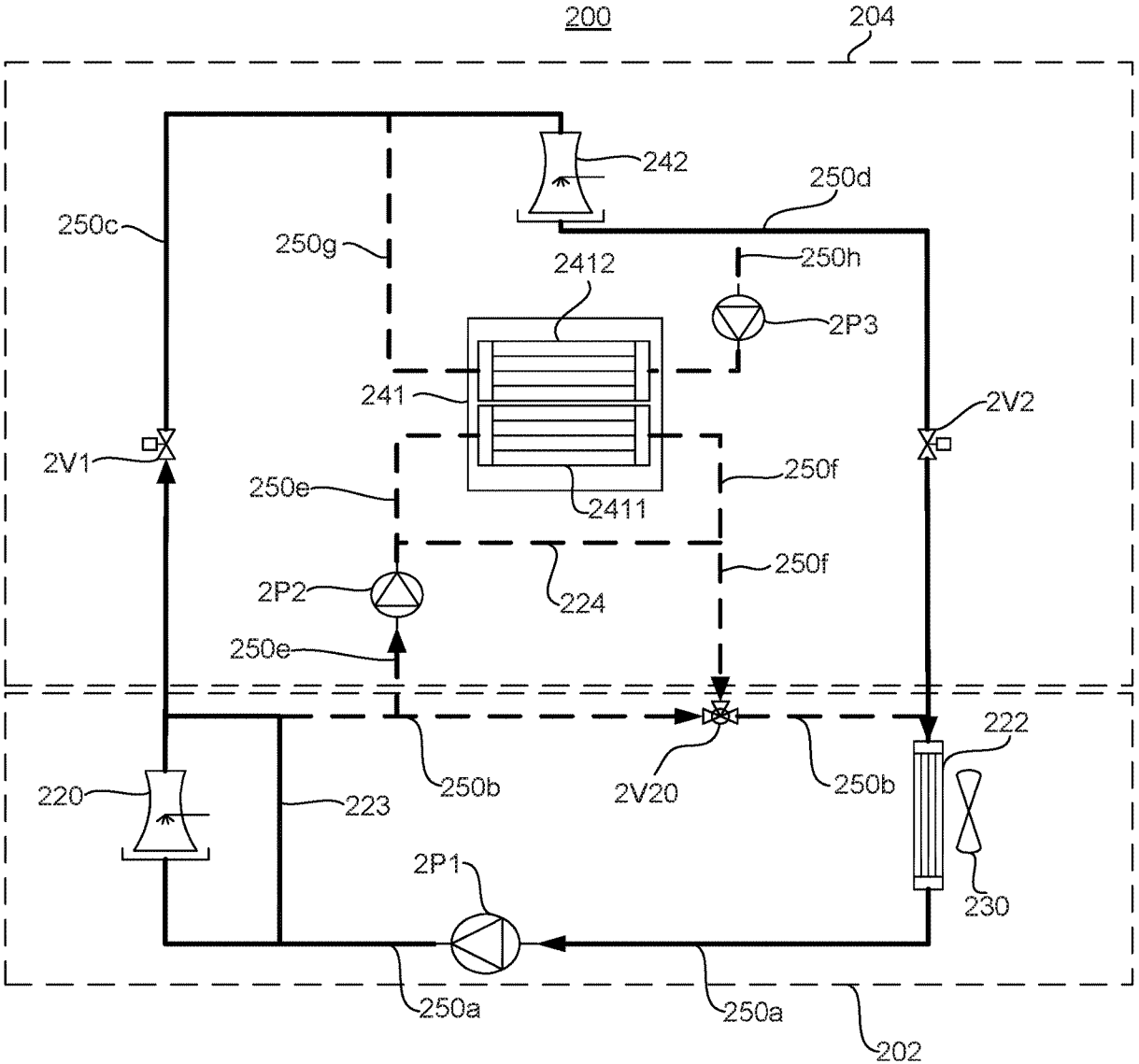
FIG. 4 is a schematic diagram of an exemplary chilled water cooling system in a natural cooling mode consistent with embodiments of this disclosure.
Figure 5:
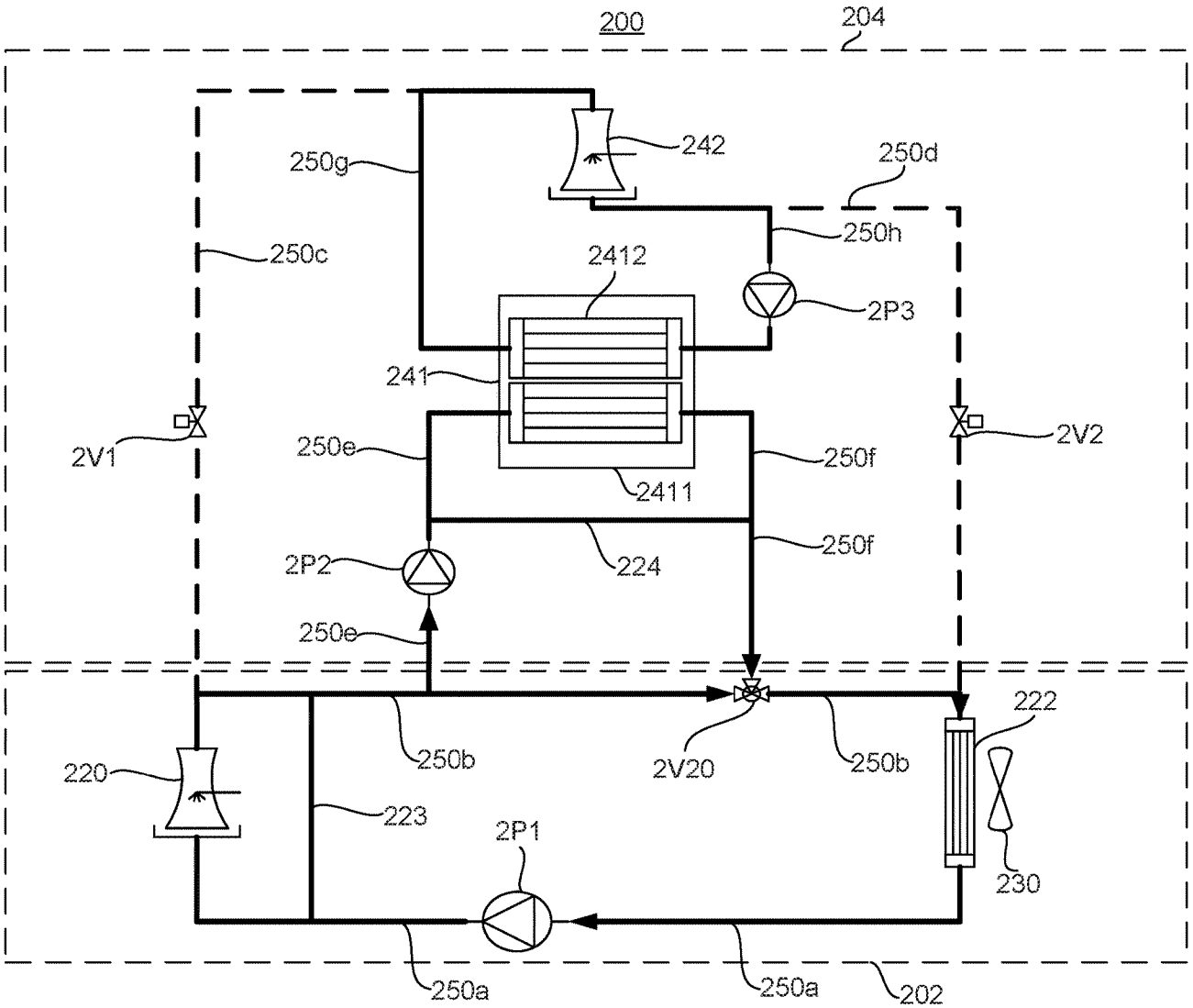
FIG. 5 is a schematic diagram of an exemplary chilled water cooling system in a partial natural cooling mode consistent with embodiments of this disclosure.

A second embodiment of the present disclosure provides a chilled water cooling system including a natural cooling circuit having a cooling tower as a main cooling circuit and a water-cooled mechanical cooling circuit as an auxiliary circuit. FIGS. 4 and 5 show a chilled water cooling system 200, in which FIG. 4 shows a schematic diagram of the chilled water cooling system 200 working in a natural cooling mode, and FIG. 5 shows a schematic diagram of the chilled water cooling system 200 working in a partial natural cooling mode.

As shown in FIGS. 4 and 5, the chilled water cooling system comprises a natural cooling circuit 202 and a mechanical cooling circuit 204. The natural cooling circuit 202 includes a first cooling tower 220, a chilled water main pump 2P1, a three-way valve 2V20, pipelines 250*a*, 205*b*, a first differential pressure bypass branch 223, and a heat exchanger 222 at an air-conditioning terminal 230. The mechanical cooling circuit 204 is water-cooled, and includes a water-cooled chilled water main machine 241 having an evaporator 2411 and a condenser 2412, a chilled water auxiliary pump 2P2, a cooling water pump 2P3, a second cooling tower 242, a first valve 2V1, a second valve 2V2, and pipelines 250*c*, 250*d*, 250*e*, 250*f*, 250*g*, 250*h*. The first cooling tower 220 and the second cooling tower 242 may be a closed cooling tower, such as a spray closed cooling tower.

Hereinafter, a structure of the chilled water cooling system 200 will be explained in detail.

In the natural cooling circuit 202, one end of the first cooling tower 220 is connected in series to one end of the heat exchanger 222 at the air-conditioning terminal 230 through the chilled water main pump 2P1 and the pipeline 250*a*. The other end of the heat exchanger 222 at the air-conditioning terminal 230 is connected to one end of the first cooling tower 220 through pipeline 250*b* and the three-way valve 2V20. In order to provide overpressure protection to the first cooling tower 220, the first differential pressure bypass branch 223 is connected in parallel to the first cooling tower 220.

In the mechanical cooling circuit 204, ends of the evaporator 2411 of the water-cooled chilled water main machine 241 are connected to pipeline 250*b* through pipelines 250*e* and 250*f*. One end of the pipeline 250*f* is connected to pipeline 250*b* through the three-way valve 2V20. The chilled water auxiliary pump 2P2 is disposed on one of the pipelines 250*e* and 250*f* (250*e* in the illustrated embodiments). In order to provide overpressure protection to the water-cooled chilled water main machine 241, the second differential pressure bypass branch 224 is connected in parallel to the water-cooled chilled water main machine 241. Two ends of the condenser 2412 of the water-cooled chilled water main machine 241 are connected to two ends of the second cooling tower 242 through the pipelines 250*g* and 250*h*. The cooling water pump 2P3 is disposed on one of pipelines 250*g* and 250*h* (250*h* in the illustrated embodiments). One end of the second cooling tower 242 is, through the first valve 2V1 and the pipeline 250*c*, connected onto a section of the pipeline 250*b* that connects the three-way valve 2V20 with the first cooling tower 220, and the other end of the second cooling tower 242 is, through the second valve 2V2 and the pipeline 250*d*, connected to a section of the pipeline 250*b* that connects the three-way valve 2V20 with the heat exchanger 222 at the air-conditioning terminal 230. That is, the mechanical cooling circuit 204 is connected in parallel to the natural cooling circuit 202 via a controllable connecting device, e.g., the three-way valve 2V20. The first valve 2V1 and the second valve 2V2 are disposed at a junction of the natural cooling circuit 202 and the mechanical cooling circuit 204.

The chilled water cooling system 200 may have two working modes, i.e. the natural cooling mode and the partial natural cooling mode.

Referring to FIG. 4, in the natural cooling mode, the three-way valve 2V20 is closed, blocking the flow in the pipeline 250*b* from the first cooling tower 220 to it and the flow form in the pipeline 205*f* from the water-cooled chilled water main machine 241 to it. The first valve 2V1 and the second valve 2V2 are open. In the natural cooling mode, after the chilled water absorbs heat at the heat exchanger 222 at the air-conditioner 230, it is returned to the first cooling tower 220 under the operation of the chilled water main pump 2P1. The chilled water is cooled at the first cooling tower 220, passes through the first valve 2V1, and is cooled again at the second cooling tower 242. Subsequently, the chilled water flows through the second valve 2V2 to return to the heat exchanger 122 at the air-conditioner 230. The circulation of the chilled water is driven by the pressure provided by the chilled water main pump 2P1. When the chilled water passes through the first cooling tower 220 and the second cooling tower 242, the absorbed heat is discharged into the outdoor environment via the chilled water using the cooling pipelines (not shown) of the first cooling tower 220 and the second cooling tower 242. The temperature of the chilled water is lowered to a predetermined temperature so that the chilled water can be used as the cooling medium in the heat exchanger 222 at the air-conditioner 230 to remove heat again. In the natural cooling mode, because the three-way valve 2V20 is closed and the first valve 2V1 and the second valve 2V2 are opened, chilled water is cooled by the first cooling tower 220 and the second cooling tower 242, but not by water-cooled chilled water main machine 241. That is, the chilled water does not go through pipelines 250*e* and 250*f*, shown by the dotted line in FIG. 4. In this working mode, neither the chilled water auxiliary pump 2P2 nor the water-cooled chilled water main machine 241 is activated to work.

Referring to FIG. 5, in the partial natural cooling mode, the first valve 2V1 and the second valve 2V2 are closed, blocking the chilled water from circulating through the pipelines 250*c* and 250*d* connected with the first valve 2V1 and the second valve 2V2, as shown by the dotted line in FIG. 5. The three-way valve 2V20 is configured to allow the chilled water to move in the pipeline 250*b* connecting one end of the first cooling tower 220 and the heat exchanger 222 of air conditioner 230, and allow the chilled water from pipeline 250*f* to flow to the pipeline 250*b*. The chilled water main pump 2P1 and the chilled water auxiliary pump 2P2 are both turned on to drive the chilled water to flow in the circuit. The chilled water is first cooled by the first cooling tower 220, and a portion of the chilled water (e.g., 20%) is further cooled by the water-cooled chilled water main machine 241 when passing through the evaporator 2411 in the water-cooled chilled water main machine 241 under the pressure provided by the chilled water auxiliary pump 2P2. After cooled by the water-cooled chilled water main machine 241, the portion of the chilled water is mixed with the chilled water in the pipeline 250*b* via the three-way valve 2V20. The mixed chilled water is returned again to the heat exchanger 222 at the end of the air-conditioner 230 after cooled to a predetermined temperature. Condenser 2412 of the water-cooled chilled water main machine 241 is provided to lower the temperature of the portion of the chilled water. The cooling water in pipelines 250*g* and 250*d* is driven by the cooling water pump 2P3 to send the cooling water to the second cooling tower 242 to lower the temperature of the cooling water.

In the above-illustrated embodiment, because the mechanical cooling circuit 204 adopts the water-cooling chilled water main machine 241, which has higher energy and cooling efficiency than an air-cooled chilled water main machine, the cooling system 200 can save more energy. The cooling system 200 includes a first cooling tower 220 to cool the chilled water. In the natural cooling mode, the second cooling tower 242 of water-cooled chilled water main machine 241 can also be used to further cool the chilled water while the water-cooled chilled water main machine 241 is turned off. Thus, the second cooling tower 242 is utilized not only in the partial natural cooling mode but also the natural cooling mode, so that it enhances the natural cooling capability and reduces the time required to cool down the chilled water. The cooling system 200 thus has improved cooling efficiency and reduces energy consumption.

Figure 6:
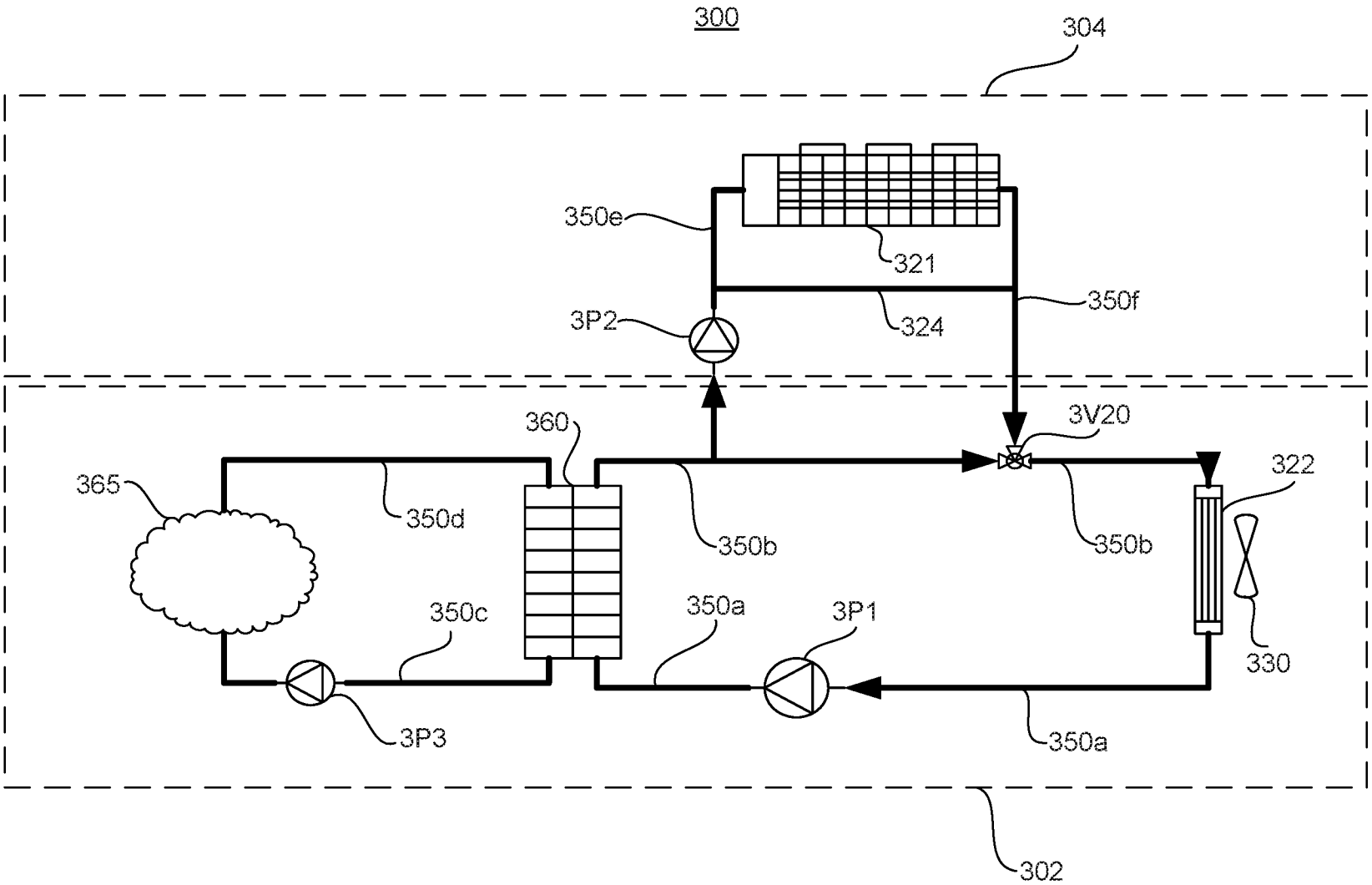
FIG. 6 is a schematic diagram of an exemplary chilled water cooling system consistent with embodiments of this disclosure.

A third embodiment of the present disclosure provides a chilled water cooling system including a heat exchanger as a natural cooler using lake water, seawater, or other cold water resources as a cooling medium, and an air-cooled chilled water main machine as a mechanical cooler. FIG. 6 is a schematic diagram of such a system.

As shown in FIG. 6, the chilled water cooling system 300 includes a natural cooling circuit 302 and a mechanical cooling circuit 304. The natural cooling circuit 302 includes a heat exchanger 360 using lake water, seawater, or other cold water resources as a cooling medium, a chilled water main pump 3P1, lake water, seawater, or other cold water resources 365, cold water resource pump 3P3, pipelines 350*a*, 350*b*, 350*c*, 350*d*, a three-way valve 3V20, and a heat exchanger 322 at an air-conditioner 330. The mechanical cooling circuit 304 includes an air-cooled chilled water main machine 321, a chilled water auxiliary pump 3P2, a differential pressure bypass branch 324, and pipelines 350*e*, 350*f*. The heat exchanger 360 may be a plate heat exchanger.

Hereinafter, a structure of the chilled water cooling system 300 will be explained in detail.

In the natural cooling circuit 302, referring to FIG. 6, to the right of the heat exchanger 360 is referred to as a high-temperature side and to the left of the heat exchanger 360 where cold water resource is located is referred to as a low-temperature side. On the high-temperature side, an end of the heat exchanger 360 is connected to one end of the heat exchanger 322 via the chilled water main pump 3P1 through pipelines 350*a*. The other end of the heat exchanger 322 is connected to an end of heat exchanger 360 via the three-way valve 3V20 through pipeline 350*b*. On the low-temperature side, two ends of the heat exchanger 360 are connected to lake water, seawater or other cold water resources 365 through pipelines 350*c*, 350*d*. The circulation of the cold water resources 365 is driven by the cold water resource pump 3P3, which is disposed on one of the pipelines 350*c* and 350*d* (350*c* shown in FIG. 6).

In the mechanical cooling circuit 304, both ends of the air-cooled chilled water main machine 121 are, through pipelines 350*e*, 350*f*, connected to the pipeline 350*b*. One end of the pipeline 350*f* is connected to the pipeline 350*b* via the three-way valve 3V20. The chilled water auxiliary pump 3P2 is disposed on one of the pipelines 350*e*, 350*f* (350*e* shown in FIG. 6). The second differential pressure bypass branch 324 is connected to the air-cooled chilled water main machine 321 in parallel. Thus, the mechanical cooling circuit 304 is connected in parallel to the natural cooling circuit 302 via a controllable connecting device, e.g., the three-way valve 3V20.

The chilled water cooling system 300 may have two working modes, i.e. a natural cooling mode and a partial natural cooling mode.

In the natural cooling mode, the three-way mixing valve 3V20 is configured to allow the chilled water flow in the pipeline 350*b* that connects the heat exchanger 360 with one end of the heat exchanger 322 of the air-conditioner 330, and block the flow from pipeline 350*f* of the mechanical cooling circuit 304. In this mode, the chilled water main pump 3P1 is activated to force the chilled water to pass through the heat exchanger 360, which uses lake water, seawater or other cold water resources 365 as a cooling medium to cool the chilled water, and to return to another end of the heat exchanger 322 of the air-conditioner 330. By passing the heat exchanger 360, the chilled water discharges the absorbed heat to lake water, seawater or other cold water resources 365 so that the temperature of the chilled water flowing back to the heat exchanger 322 through pipeline 350*b* can be lowered to a predetermined temperature or temperature range. The chilled water can act as the cooling medium to take away heat in heat exchanger 322 at the air conditioning terminal 330. In this mode, because three-way mixing valve 3V20 is configured to block the flow from pipeline 350*f*, the chilled water is only cooled by the heat exchanger 360 using lake water, seawater or other cold water resources 365 as a cooling medium, but not cooled by the mechanical cooling circuit 304. Both the chilled water auxiliary pump 3P2 and air-cooled chilled water main machine 321 are turned off.

In the partial natural cooling mode, the three-way mixing valve 3V20 is configured to allow the chilled water to flow through pipeline 350*b*, that connects one end of the heat exchanger 360 with one end of the heat exchanger 322 of the air conditioning terminal 330. In addition, the three-way mixing valve 3V20 is configured to allow the chilled water in the mechanical cooling circuit 304 to flow to pipeline 350*b*. The chilled water main pump 3P1 and the chilled water auxiliary pump 3P2 are both turned on to drive the chilled water to flow in the circuits 302, 304. After the chilled water absorbs heat at the heat exchanger 322, it is forwarded by chilled water main pump 3P1 to heat exchanger 360. The chilled water is first cooled by the heat exchanger 360, which uses lake water, seawater or other cold water resources 365 as a cooling medium. Then, a portion of the chilled water (e.g., 20%) flowing from the heat exchanger 360 is driven by the chilled water auxiliary pump 3P2 to flow to pipeline 350*e* of the mechanical cooling circuit 304, and is cooled by the air-cooled chilled water main machine 321. The portion of the chilled water is then moved through the pipeline 350*f* and is mixed with the chilled water in the pipeline 350*b* through the three-way valve 3V20. The cooled chilled water having a predetermined temperature is returned back to the heat exchanger 322 of the air conditioning terminal 330.

In the above-illustrated embodiment, cooling system 300 not only includes a main cooling circuit that uses the natural cooling circuit 302, but also an auxiliary cooling circuit that uses the air-cooled chilled water main machine 321. The natural cooling circuit 302 includes the heat exchanger 360 using lake water, seawater, or other cold water resources 365 as a cooling medium. Since the thermal conductivity of water is higher than that of air, the natural cooling capacity and efficiency of the natural cooling circuit 302 are further improved.

Figure 7:
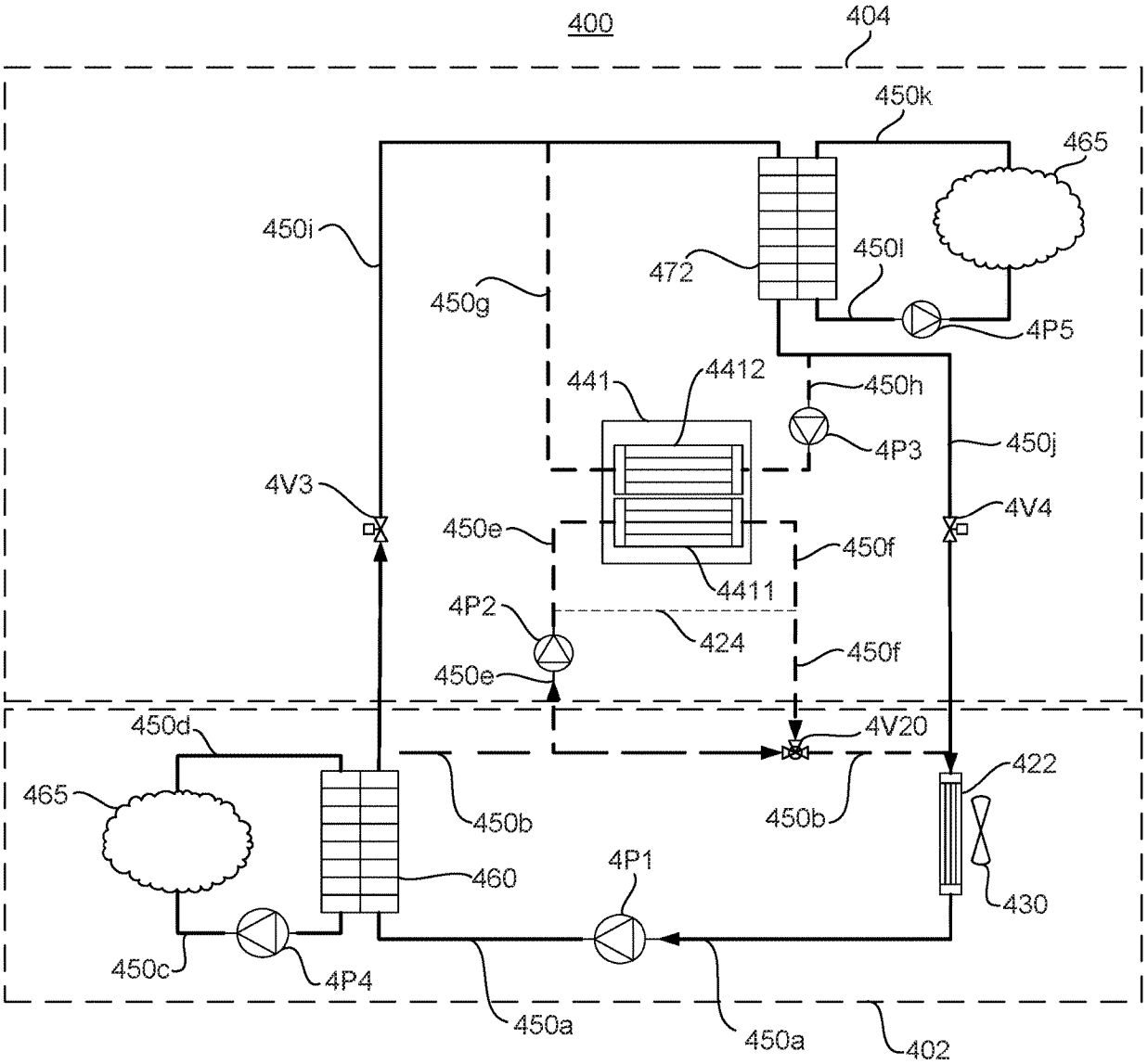
FIG. 7 is a schematic diagram of an exemplary chilled water cooling system in a natural cooling mode consistent with embodiments of this disclosure
Figure 8:
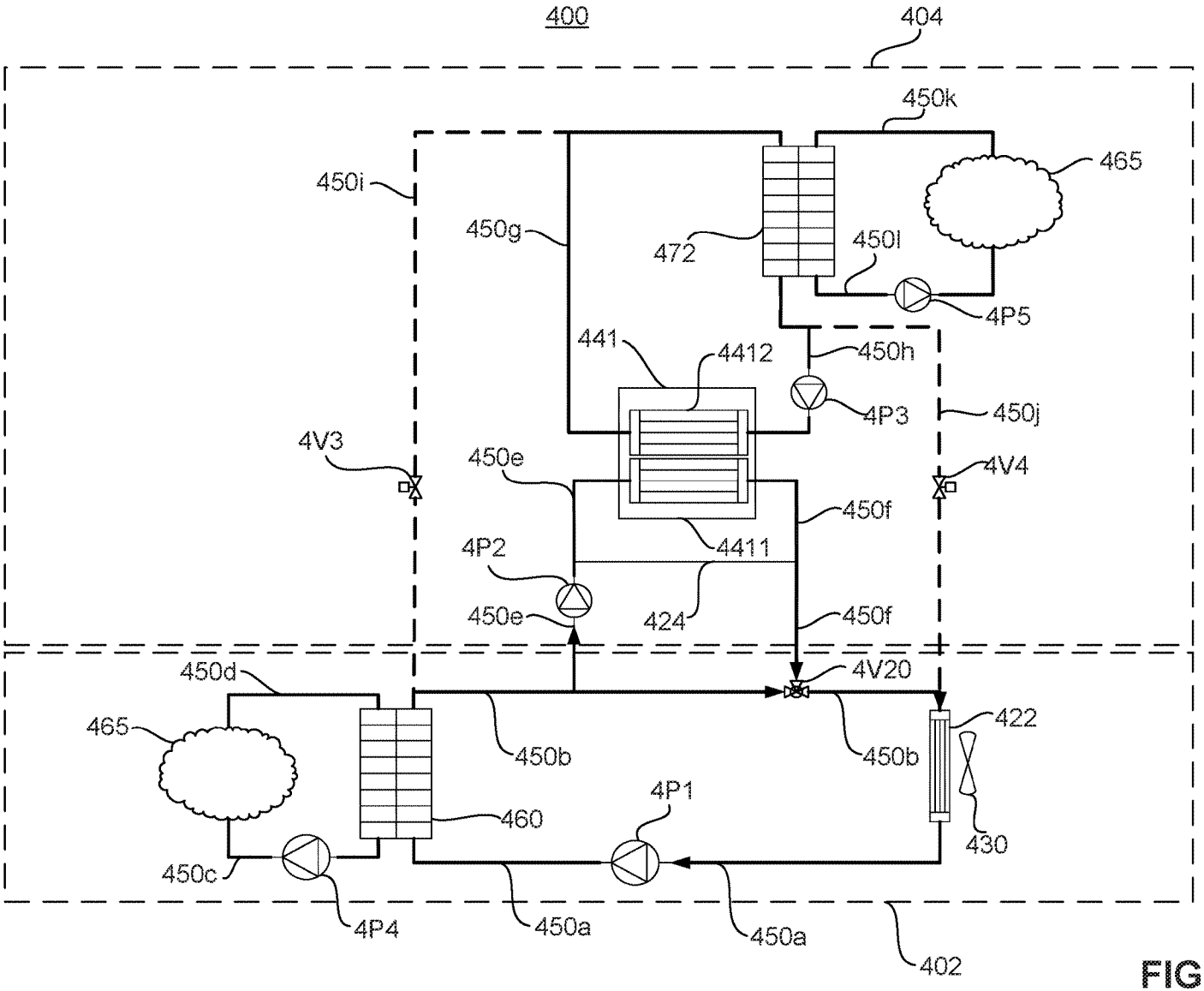
FIG. 8 is a schematic diagram of an exemplary chilled water cooling system in a partial natural cooling mode consistent with embodiments of this disclosure.

A fourth embodiment of the present disclosure provides a chilled water cooling system including a natural cooler having a heat exchanger using lake water, seawater, or other cold water resources as a cooling medium, and a mechanical cooler having a water-cooled chilled water main machine. A condensation side of the water-cooled chilled water main machine also includes a heat exchanger that uses lake water, seawater, or other cold water resources as a cooling medium to cool. FIG. 7 is a schematic diagram of a natural cooling mode of a chilled water cooling system 400; FIG. 8 is a schematic diagram of a partial natural cooling mode of the chilled water cooling system 400.

As shown in FIGS. 7 and 8, the chilled water cooling system 400 includes a natural cooling circuit 402 and a mechanical cooling circuit 404. The natural cooling circuit 402 includes a first heat exchanger 460 using lake water, seawater, or other cold water resources 465 as a cooling medium, a chilled water main pump 4P1, lake water, seawater or other cold water resources 465, pipelines 450*a*, 450*b*, 450*c*, 450*d*, a three-way valve 4V20, a first cold-water-resource pump 4P4, and a heat exchanger 422 of an air conditioning terminal 430. The mechanical cooling circuit 404 includes a water-cooled chilled water main machine 441 having an evaporator 4411 and a condenser 4412, a chilled water auxiliary pump 4P2, a second differential pressure bypass branch 424, a cooling water pump 4P3, a second heat exchanger 472 using lake water, seawater, or other cold water resources 465 as a cooling medium, lake water, seawater, or other cold water resources 465, a second cold-water-resource pump 4P5, pipelines 450*e*, 450*f*, 450*g*, 450*h*, 450*i*, 450*j*, 450*k*, 4501, a third valve 4V3, and a fourth valve 4V4. The first heat exchanger 460 and second heat exchanger 472 may be a plate heat exchanger.

Hereinafter, a structure of the chilled water cooling system 400 will be explained in detail.

In the natural cooling circuit 402, referring to FIGS. 7 and 8, to the right of the heat exchanger 460 is referred to as a high-temperature side and to the left of the heat exchanger 460 where cold water resource is located is referred to as a low-temperature side. On the high-temperature side, one end of the heat exchanger 460 is connected to one end of the heat exchanger 422 of the air conditioning terminal 430 via the pipeline 450*a* and the chilled water main pump 4P1. The other end of the heat exchanger 422 at the air conditioning terminal 430 is connected, via the pipeline 450*b* and the three-way valve 4V20, to one end of the first heat exchanger 460. On the low-temperature side, two ends of the heat exchanger 460 are connected to lake water, seawater or other cold water resources 465 through pipelines 450*c*, 450*d*. The circulation of the cold water resources 465 is driven by the first cold-water-resource pump 4P4.

In the mechanical cooling circuit 404, two ends of the evaporator 4411 of the water-cooled chilled water main machine 441 are connected, via pipelines 450*e*, 450*f*, to pipeline 450*b*, which connects the first heat exchanger 460 with the heat exchanger 422 at the air conditioning terminal 430. The pipeline 450*f* is connected to the pipeline 450*b* via the three-way valve 4V20. The chilled water auxiliary pump 4P2 is disposed on one of the pipelines 450*e* and 450*f* (450*e* shown in FIGS. 7 and 8). The second differential pressure bypass branch 424 joins with pipelines 450*e* and 450*f* on both sides of the evaporator 4411 of the water-cooled chilled water main machine 441, and is connected to the water-cooled chilled water main machine 441 in parallel. Two ends of the condenser 4412 of the water-cooled chilled water main machine 441 are connected, via pipelines 450*g* and 450*h*, to two ends of the second heat exchanger 472, which uses lake water, seawater, or other cold water resources 465 as a cooling medium. The cooling water pump 4P3 is disposed on one of the pipelines 450*g* and 450*h* (450*h* shown in FIGS. 7 and 8). One end of the second heat exchanger 472 is also connected, via the third valve 4V3 and pipeline 450*i*, to a section of the pipeline 450*b* that connects the first heat exchanger 460 to the three-way valve 4V20. Another end of the second heat exchanger 472 is connected, via the fourth valve 4V4 and pipeline 450*j*, to a section of the pipeline 450*b* that connects the three-way valve 4V20 to the heat exchanger 422 of the air conditioning terminal 430. The low temperature fluid side (to the right of the second heat exchanger 472 in FIGS. 7 and 8) of the second heat exchanger 472 is connected, via pipeline 450*k*, 4501, to the lake water, seawater, or other cold water resources 465. The second cold-water-resource pump 4P5 is disposed in one of the pipelines 450*k* and 450*l* (4501 shown in FIGS. 7 and 8). Thus, the mechanical cooling circuit 404 is connected in parallel to the natural cooling circuit 402 via a controllable connecting device, e.g., the three-way valve 4V20. In some embodiments, the third valve 4V3 and the fourth valve 4V4 are disposed at a junction of the natural cooling circuit 402 and the mechanical cooling circuit 404.

The chilled water cooling system 400 may have two modes of operation, i.e. a natural cooling mode and a partial natural cooling mode.

Referring to FIG. 7, in the natural cooling mode, the three-way valve 4V20 is closed, blocking the flow in the pipelines 450*b* connecting the first heat exchanger 460 and one end of the heat exchanger 422 of the air conditioning terminal 430 and the flow in the pipeline 450*f*. The third valve 4V3 and the fourth valve 4V4 are open to allow passage of the chilled water. Under the natural cooling mode, the chilled water main pump 4P1 is turned on to work. Under the pressure provided by the chilled water main pump 4P1, the chilled water that absorbs heat from the heat exchanger 422 at the air conditioning terminal 430 passes through and is cooled by the first heat exchanger 460 using lake water, seawater, or other cold water resources 465 as a cooling medium. The chilled water then goes through the third valve 4V3, and passes through and is further cooled by the second heat exchanger 472 using lake water, seawater, or other cold water resources 465 as a cooling medium. The chilled water then passes through the fourth valve 472 and returns to another end of the heat exchanger 422 of the air conditioning terminal 430. When the chilled water passes through the first heat exchanger 460 and the second heat exchanger 472, the absorbed heat is discharged to lake water, seawater, or other cold water resources 465 so that the temperature of the chilled water returned to the heat exchanger 422 at the air conditioning terminal 430 can be lowered to a predetermined temperature, and that the chilled water can be used as a cooling medium in the heat exchanger 422 at the air conditioning terminal 430 to take away heat again. In this working mode, because three-way valve 4V20 is closed, and the third valve 4V3 and the fourth valve 4V4 are opened, the chilled water is only cooled by the first heat exchanger 460 and the second heat exchanger 472 using lake water, seawater, or other cold water resources 460 as a cooling medium, but not by the water-cooled chilled water main machine 441. Neither the chilled water auxiliary pump 4P2 nor the water-cooled chilled water main machine 441 is turned on to work.

Referring to FIG. 8, in the partial natural cooling mode, the three-way valve 4V20 is open to allow flows in the pipelines 450*b* and 450*f*. The third valve 4V3 and the fourth valve 4V4 are closed so that the flow in the pipelines 450*i* and 450*j* is blocked as shown by the dotted line in FIG. 8. The chilled water main pump 4P1 and the chilled water auxiliary pump 4P2 are both turned on to drive the chilled water to flow in the circuits. The chilled water is first cooled by the heat exchanger 460 using lake water, seawater, or other cold water resources 465 as a cooling medium. A portion of the chilled water (e.g., 20%), under the pressure provided by the chilled water auxiliary pump 4P2, flows in pipeline 450*e*, and passes through the evaporator 4411 in the water-cooling chilled water main machine 441 and is cooled by the water-cooling chilled water main machine 441. The cooled portion of the chilled water is moved through pipeline 450*f* and is mixed with the chilled water in the pipeline 450*b* through the three-way valve 4V20. The mixed chilled water is returned to the heat exchanger 422 of the air conditioning terminal 430 after it is cooled to a predetermined temperature or temperature range. Cooling water pump 4P3 is turned on to drive cooling water between the condenser 4412 and second heat exchanger 472. The condenser 4412 of the water-cooled chilled water main machine 441 lowers the temperature of the chilled water at the second heat exchanger 472 using lake water, seawater, or other cold water resources 465 as a cooling medium.

In the above-illustrated embodiment, the cooling system 400 uses a natural cooling circuit as a primary cooler, and a water-cooled chilled water main machine as an auxiliary cooler. Since the water-cooled chilled water main machine has energy efficiency higher than that of an air-cooled chilled water main machine, the cooling efficiency of the auxiliary mechanical cooling circuit 404 is improved. Further, both of the water-cooled chilled water main machine 472 and the natural cooling circuit 402 use heat exchangers that use lake water, seawater, or other cold water resources 465 having thermal conductivity higher than that of air as a cooling medium. Moreover, in the natural cooling mode, the heat exchanger 472 of the water-cooled chilled water main machine 441 may be employed to perform natural cooling, which improves the natural cooling capability, thereby improving the cooling efficiency and reducing the energy consumption.

Figure 9:
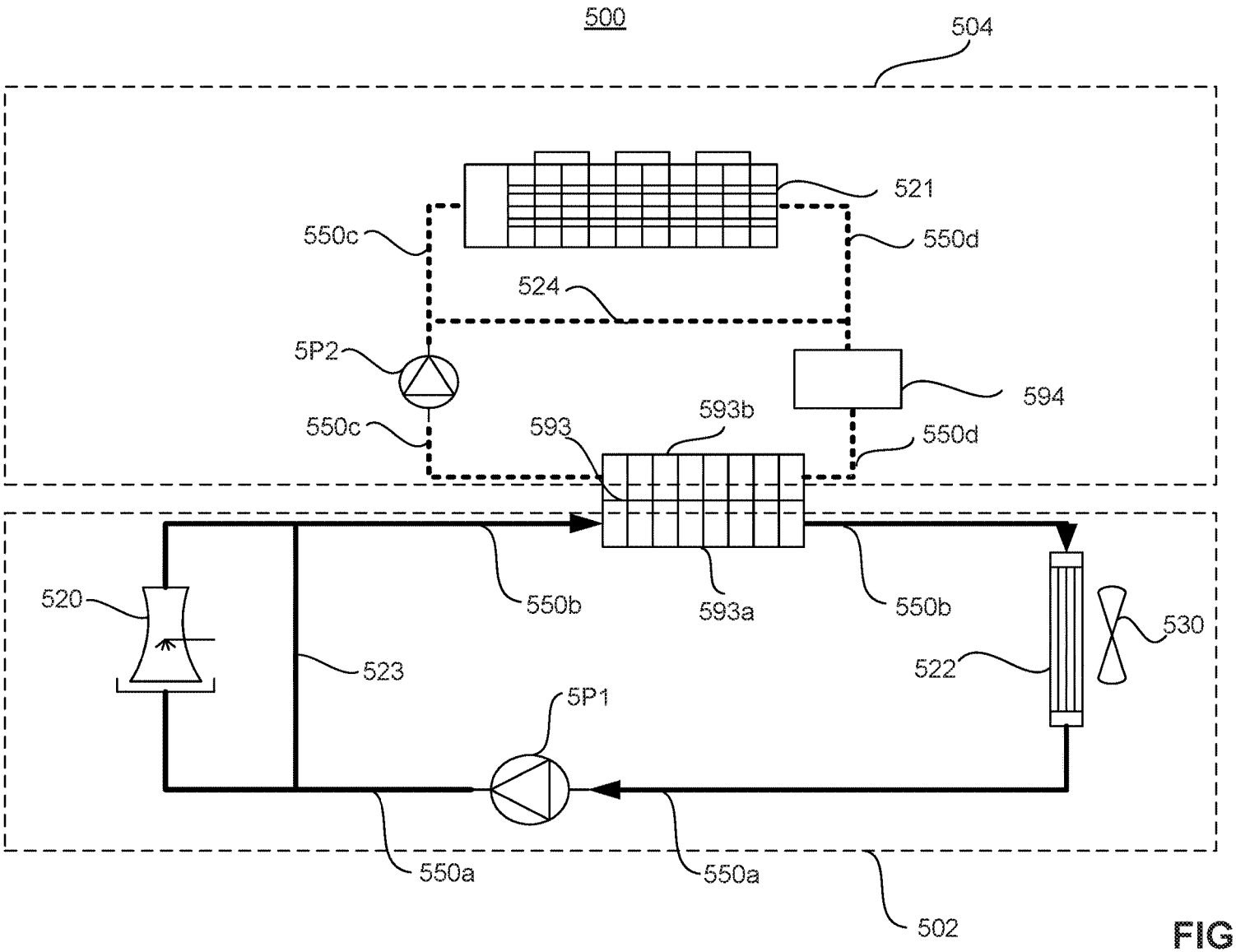
FIG. 9 is a schematic diagram of an exemplary chilled water cooling system consistent with embodiments of this disclosure.

The fifth embodiment of the present disclosure provides a chilled water cooling system 500 in which a natural cooling circuit is isolated from a mechanical cooling circuit by a heat exchanger. FIG. 9 is a schematic diagram of the cooling system 500.

As shown in FIG. 9, the chilled water cooling system 500 includes a natural cooling circuit 502 having a cooling tower 520 and a mechanical cooling circuit 504 having an air-cooled chilled water main machine 521. The natural cooling circuit 502 includes a cooling tower 520, a first differential pressure bypass branch 523, a chilled water main pump 5P1, a high temperature fluid side 593*a* of a heat exchanger 593, pipelines 550*a*, 550*b*, and a heat exchanger 522 of the air conditioning terminal 530. The mechanical cooling circuit 504 includes a low temperature fluid side 593*b* of the heat exchanger 593, an air-cooled chilled water main machine 521, a second differential pressure bypass branch 524, a chilled water auxiliary pump 5P2, a thermal storage device 594, and pipelines 550*c*, 550*d*. The heat exchanger 593 may be a plate heat exchanger, and the thermal storage device 594 may be a thermal storage tank.

Hereinafter, a structure of the chilled water cooling system 500 will be explained in detail.

Referring to FIG. 9, in the natural cooling circuit 502, one end of the cooling tower 520 is connected to one end of the heat exchanger 522 at the air conditioning terminal 530 via the chilled water main pump 5P1 and the pipeline 550*a*. The other end of the cooling tower 520 is connected to one end of the high temperature fluid side 593*a* of the heat exchanger 593 through pipeline 550*b*. The other end of the heat exchanger 522 of the air conditioning terminal 530 is connected, via the pipeline 550*b*, to one end of the high temperature fluid side 593*a* of the heat exchanger 593. In order to provide overpressure protection to the cooling tower 520, the first differential pressure bypass branch 523 joins with pipelines 550*a* and 550*b* on both sides of the cooling tower 520, and is connected to the cooling tower 520 in parallel.

In the mechanical cooling circuit 504, two ends of the air-cooled chilled water main machine 521 are, via the pipelines 550*c* and 550*d*, connected to two ends of the low temperature fluid side 593*b* of the heat exchanger 593. The chilled water auxiliary pump 5P2 and the thermal storage device 594 are disposed on the pipelines 550*c* and 550*d*, respectively.

The chilled water cooling system 500 may have two working modes, i.e., a natural cooling mode and a partial natural cooling mode.

In the natural cooling mode, the chilled water main pump 5P1 is turned on to work. The chilled water that absorbs heat from heat exchanger 522 of the air conditioning terminal 530 passes through the cooling tower 520 and the high temperature fluid side 593*a* of the heat exchanger 593 and returns back to another end of the heat exchanger 522 of the air conditioning terminal 530, under the pressure provided by the chilled water main pump 5P1. When the chilled water passes through the cooling tower 520, the heat of the chilled water is discharged to outdoor environment via the cooling pipelines (not shown) of the cooling tower 520. The temperature of the chilled water passing through the cooling tower 520 is lowered to a predetermined temperature. The chilled water does not exchange heat when passing the heat exchanger 593 because the mechanical cooling circuit 504 is not activated to work, and returns to the heat exchanger 522 of the air conditioning terminal 530 to take away heat as a cooling medium. In this working mode, the mechanical cooling circuit 504 does not assist in cooling the chilled water. Neither the chilled water auxiliary pump 5P2 nor the air-cooled chilled water main machine 521 is turned on to work.

In the partial natural cooling mode, both the chilled water main pump 5P1 and the chilled water auxiliary pump 5P2 are turned on to work. The air-cooled chilled water main machine 521 is also turned on to work. The chilled water that absorbs heat from the heat exchanger 522 of the air conditioning terminal 530 passes through the cooling tower 520 and the high temperature fluid side 593*a* of the heat exchanger 593, and returns to another end of the heat exchanger 522. Under the partial natural cooling mode, the chilled water is first cooled by the cooling tower 520, in which the heat absorbed from the heat exchanger 522 is discharged to outdoor environment via the cooling pipelines (not shown) of the cooling tower 520. If the temperature of the chilled water is still higher than a predetermined temperature or temperature range required by the heat exchanger 522, the air-cooled chilled water main machine 521 is turned on to further cool the chilled water. The chilled water auxiliary pump 5P2 is turned on, pushing the cooling liquid in the thermal storage device 594 to circulate in the mechanical cooling circuit 504. When the chilled water passes through the heat exchanger 593, the heat of the chilled water is further absorbed by the low temperature cooling liquid flowing on another side 593*b* of the heat exchanger 593. The temperature of the chilled water is further lowered to the predetermined temperature or temperature range required for the heat exchanger 522. The chilled water as a cooling medium can take away heat again at the heat exchanger 522 of the air conditioning terminal 530. The cooling liquid of the mechanical cooling circuit 504 is sent to the air-cooled chilled water main machine 521 for cooling after absorbing the heat at the heat exchanger 593. Under this mode, the air-cooled chilled water main machine 521 in the mechanical cooling circuit 504 is employed to cool the cooling liquid, which in turn cools the chilled water at the heat exchanger 593.

In the above-illustrated embodiment, the chilled water cooling system 500 can cool the chilled water by not only the cooling tower 520 of the natural cooling circuit 502 but also by the air-cooled chilled water main machine 521 when the temperature of the chilled water is still too high and exceeds the predetermined temperature range for the heat exchanger 522 of the air-conditioning terminal 530.

The natural cooler in the present disclosure may be a closed cooling tower, a spray closed cooling tower, a heat exchanger, a plate heat exchanger, or a dry cooler etc. The terminal heat exchanger connected in series in the natural cooling circuit may be a heat exchanger at the air conditioning terminal as described in above embodiments, or a heat exchanger of liquid cooling system, or other terminal heat exchanger.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A chilled water cooling system, comprising:

a natural cooling circuit including a natural cooler, a chilled water main pump, at least one first pipeline, and a terminal heat exchanger connected in series, the terminal heat exchanger being disposed at a location in need of cooling; and a mechanical cooling circuit including a chilled water main machine, a chilled water auxiliary pump, and at least one second pipeline connected in series, wherein the mechanical cooling circuit is connected in parallel with the terminal heat exchanger and the natural cooling circuit through a three-way valve disposed between the mechanical cooling circuit and the natural cooling circuit.

2. The chilled water cooling system of claim 1, wherein the chilled water main machine is a water-cooled chilled water main machine.

3. The chilled water cooling system of claim 2, wherein the water-cooled chilled water main machine includes a first cooling tower.

4. The chilled water cooling system of claim 3, wherein the first cooling tower is a closed cooling tower.

5. The chilled water cooling system of claim 3, wherein the natural cooler includes a second cooling tower.

6. The chilled water cooling system of claim 5, wherein the second cooling tower is a closed cooling tower.

7. The chilled water cooling system of claim 5, wherein the first cooling tower is incorporated into the natural cooling circuit via third pipelines, a first valve, and a second valve, the first valve and the second valve being disposed on an input side and an output side of the first cooling tower, respectively, and wherein, in a natural cooling mode, the first cooling tower and the second cooling tower are connected in series by turning on the first valve and the second valve.

8. The chilled water cooling system of claim 7, wherein the first valve and the second valve are disposed at a junction of the natural cooling circuit and the mechanical cooling circuit.

9. The chilled water cooling system of claim 2, wherein the water-cooled chilled water main machine includes a first heat exchanger that uses cold water resources as a cooling medium.

10. The chilled water cooling system of claim 9, wherein the natural cooler includes a second heat exchanger that uses cold water resources as a cooling medium.

11. The chilled water cooling system of claim 10, wherein the first heat exchanger is incorporated into the natural cooling circuit via third pipelines, a third valve, and a fourth valve, the third valve and the fourth valve being disposed at an input side and an output side of the first heat exchanger, respectively, and wherein, in a natural cooling mode, the first heat exchanger and the second heat exchanger are connected in series by turning on the third valve and the fourth valve.

12. The chilled water cooling system of claim 11, the third valve and the fourth valve are disposed at a junction of the natural cooling circuit and the mechanical cooling circuit.

13. The chilled water cooling system of claim 1, wherein the chilled water main machine is an air-cooled chilled water main machine.

14. The chilled water cooling system of claim 13, wherein the natural cooler is a cooling tower.

15. The chilled water cooling system of claim 13, wherein the natural cooler includes a first heat exchanger that uses cold water resources as a cooling medium.

16. A chilled water cooling system, comprising:

a natural cooling circuit including a natural cooler, a chilled water main pump, at least one first pipeline, and a terminal heat exchanger connected in series, the terminal heat exchanger being disposed at a location in need of cooling; and a mechanical cooling circuit including a chilled water main machine, a chilled water auxiliary pump, and at least one second pipeline connected in series, wherein the mechanical cooling circuit is connected in parallel with the natural cooling circuit through a first heat exchanger, wherein the chilled water main machine is an air-cooled chilled water main machine, and the first heat exchanger having a first portion connected to the natural cooling circuit and a second portion connected to the mechanical cooling circuit, and wherein the second portion of the first heat exchanger is connected in series with a thermal storage device disposed in the mechanical cooling circuit.

17. The chilled water cooling system of claim 16, wherein the natural cooler includes a second heat exchanger that uses cold water resources as a cooling medium.

18. The chilled water cooling system of claim 17, wherein the second heat exchanger is a plate heat exchanger.

19. A chilled water cooling system, comprising:

a natural cooling circuit including a natural cooler, a chilled water main pump, at least one first pipeline, and a terminal heat exchanger connected in series, the terminal heat exchanger being disposed at a location in need of cooling; and a mechanical cooling circuit including a chilled water main machine, a chilled water auxiliary pump, and at least one second pipeline connected in series, wherein the mechanical cooling circuit is connected in parallel with the natural cooling circuit through a controllable connecting device, wherein the chilled water main machine is a water-cooled chilled water main machine, wherein the water-cooled chilled water main machine includes a first cooling tower, wherein the natural cooler includes a second cooling tower, wherein the first cooling tower is incorporated into the natural cooling circuit via third pipelines, a first valve, and a second valve, the first valve and the second valve being disposed on an input side and an output side of the first cooling tower, respectively, and wherein, in a natural cooling mode, the first cooling tower and the second cooling tower are connected in series by turning on the first valve and the second valve.

* * * * *